US006348291B1

(12) United States Patent
Sato

(10) Patent No.: US 6,348,291 B1
(45) Date of Patent: Feb. 19, 2002

(54) TONER, DEVELOPER AND METHODS FOR MANUFACTURING TONER AND DEVELOPER

(75) Inventor: Shuitsu Sato, Tokyo (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/657,438

(22) Filed: Sep. 7, 2000

(30) Foreign Application Priority Data

Sep. 9, 1999 (JP) ..... 11-255464

(51) Int. Cl.[7] ..... G03G 9/08

(52) U.S. Cl. ..... 430/108.6; 430/108.7; 430/137.1; 430/111.4

(58) Field of Search ..... 430/108.6, 108.7, 430/137.1, 111.4

(56) References Cited

U.S. PATENT DOCUMENTS

| | | | |
|---|---|---|---|
| 5,707,770 A | 1/1998 | Tanakawa et al. | 430/108.6 |
| 6,203,955 B1 | 3/2001 | Mochizuki | 430/108.6 |

FOREIGN PATENT DOCUMENTS

| | | |
|---|---|---|
| JP | 10-239892 | 9/1998 |

*Primary Examiner*—Christopher Rodee
(74) *Attorney, Agent, or Firm*—Foley & Lardner

(57) ABSTRACT

Toner comprises rutile/anatase mixed crystal titanium oxide that is externally added to toner particles containing binder resin and coloring agents and hydrophobic processed, and hydrophobic silica externally added to the toner particles.

8 Claims, 1 Drawing Sheet

TONER, DEVELOPER AND METHODS FOR MANUFACTURING TONER AND DEVELOPER

BACKGROUND OF THE INVENTION

1. Field of the Invention

The present invention relates to toner and developer that are used in the development by printers, electro-photographic apparatus and the like, and methods for manufacturing toner and developer.

2. Description of the Related Art

In electro-photographic apparatus or electrostatic recording devices, a two-component developer is used for developing an electrostatic latent image that is formed on a photo-conductive drum or an electrostatic image carrier made of a dielectric to a visible image. This two-component developer comprises toner and carrier. Generally, this toner is manufactured as colored fine particles in such a manner that coloring agents and other additives are mixed in a fused state in thermoplastic resin, and after uniformly dispersed, a solidified product is finely pulverized and classified to a desired particle size. Further, in recent years the development of images from monochrome color to full colors has been largely advanced in electro-photographic apparatuses or electrostatic recording devices and in general, all colors are reproduced using three color toners in yellow, cyan and magenta colors that are three primary colors.

In general, toner in a two-component developer is charged to a fixed amount and polarity by friction with carrier and adsorbed to an electrostatic latent image using the electrostatic attraction to develop the image. Therefore, the friction charge characteristic of toner that is determined by the relation with carrier is required to be satisfactory.

Further, for toners used in the full color development, an excellent transferring characteristic is demanded because a multiple-colored image is reproduced by superposing respective color toner. The transferring characteristic is largely concerned with a charge amount of toner. If the charge amount of toners is too high, adhesion power of toner to a photo-conductive drum becomes strong and transferring efficiency is lowered. Further, transferring efficiency to a paper is also lowered even when the charge amount distribution of toner is broad. On the contrary, if the charge amount of toner is too low, the toner may scatter and contaminate the inside of an apparatus or a fog may be produced on the non-image portion of a paper when an image is transferred or toner may be mixed in another image portion and an image becomes unclear and turbid.

In particular, such color toners as yellow, cyan and magenta colors do not contain such conductive materials as magnetic powder and carbon black as in a black toner. Accordingly, color toner has no portion to leak frictional charge and the charge amount of toner is not stabilized and tends to become large. Further, the charge amount is susceptible to the influence of temperature and humidity and such troubles are caused as excessive charge amount under a low humidity and insufficient charge amount under a high humidity and it was difficult to maintain the charge amount stably under all environments.

In regard to the above-mentioned problems, fine particles that are called external additives are so far added to the toner particle surfaces as a means to give charge stability, fluidity, durable stability, etc. to toner of two-component developer. In the case of color toner, it is known that such metallic oxide fine particles as titanium oxide that do not affect the hue of toner are used as external additives as conductive material like carbon black in black toner.

As examples of titanium oxide used as an external additive, Japanese Patent Application Laid-Open No. 48-47345 disclosed the use of it as an abrasive, Japanese Patent Application Laid-Open Nos. 52-19535 and 56-128956 disclosed as a fluidity agent and Japanese Patent Application Laid-Open Nos. 58-185405 and 58-216252 disclosed as a surface processed titanium oxide to give positive charging property, Japanese Patent Application Laid-Open Nos. 58-1157 and 60-136755 disclosed charge control agent to suppress charge amount of silica when jointly used with hydrophobic silica. Further, Japanese Patent Application Laid-Open Nos. 60-112052 and 5-188633 disclosed anatase titanium oxide, Japanese Patent Application No. 59-52255 disclosed alklkyl trialkoxysilane processed titanium oxide and Japanese Patent Application Laid-Open No. 7-244397 disclosed rutile titanium oxide, respectively.

However, when titanium oxide was applied to color toners as an external additive, charge stability, fluidity, durable stability, etc. were not always satisfactory. For instance, when rutile titanium oxide was used, surface activity was small and hydrophobic process was not always sufficiently applied. Further, the hydrophobic degree of titanium oxide could be increased by using much processing agent or using high viscosity processing agent, etc. However, different kinds of particles were adhered to each other so that combined particles were produced or the hydrophobic process was not uniform at the stage of the hydrophobic processing and thus, the hydrophobic process was not sufficient. Therefore, toners were inferior in fluidity and there was such a problem that a toner clamp tends to occur so as not to satisfactorily supply toner from cartridge to a developing device.

Therefore, when rutile titanium oxide was jointly used with silica in order to make up for fluidity, a new problem to impair the charging characteristic of toner was caused. Further, Japanese Patent Application Laid-Open No. 7-244397 disclosed a method to make the union of different kinds of particles difficult by making rutile titanium oxide hydrophobic uniformly in a short time by processing with organic matter after the surface processing of rutile titanium oxide with inorganic oxide. However, the hydrophobic degree is restricted up to 80% and it is difficult to obtain the hydrophobic degree above it and an improvement was required.

On the other hand, on anatase titanium oxide, there were such problems that its inherent volume resistance is low, charge leakage from toner at high humidity is fast and change is not stable, etc.

SUMMARY OF THE INVENTION

An object of the present invention is to provide toner, developer and methods for manufacturing toner and developer, capable of obtaining stabilized charging characteristic irrespective of environmental conditions such as temperature, humidity and the like, and obtaining clear and good full color images without impairing color reproducibility, transparency, fluidity of toner and causing fogs and scattering of toner to surroundings.

According to the present invention, there is provided toner comprising toner particles containing binder resin and coloring agents; rutile/anatase mixed crystal titanium oxide externally added to the toner particles and hydrophobic processed; and hydrophobic silica externally added to the toner particles.

Further, according to the present invention, there is provided developer comprising toner particles containing binder resin and coloring agents; rutile/anatase mixed crystal titanium oxide externally added to the toner particles and hydrophobic processed; hydrophobic silica externally added to the toner particles; and silicon resin coated carrier.

Further, according to the present invention, there is provided a method for manufacturing toner comprising the steps of preparing toner particles; and externally adding hydrophobic processed rutile/anatase mixed crystal titanium oxide and hydrophobic silica to the toner particles simultaneously.

According to the present invention, there is provided a method for manufacturing developer comprising the steps of manufacturing toners by externally adding hydrophobic processed rutile/anatase mixed crystal titanium oxide and hydrophobic silica simultaneously to toner particles; and mixing the toner and silicon resin coated carrier.

DETAILED DESCRIPTION OF THE PREFERRED EMBODIMENTS

Figure 1:
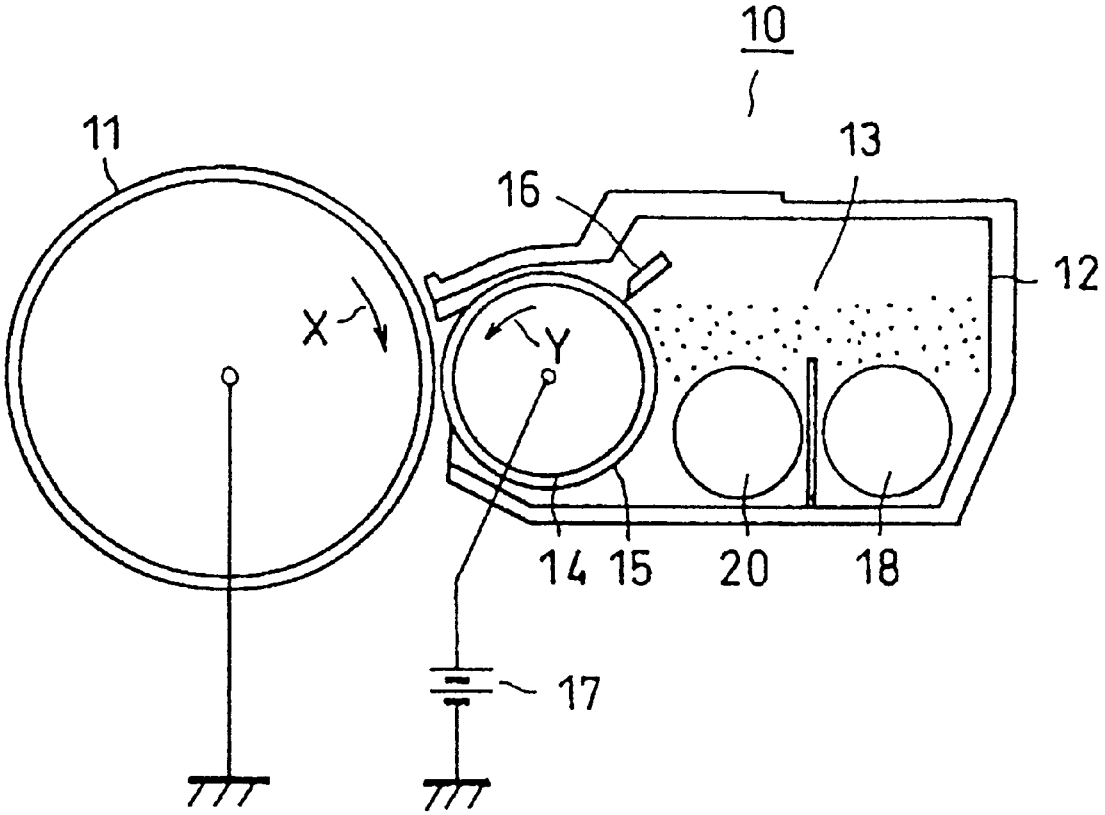
FIG. 1 is a schematic diagram showing a two-component developing device that is used for the copy test of developer of the present invention.

First, the principle of the present invention will be described. In order to compensate defects of both rutile titanium oxide and anatase titanium oxide, the present invention uses rutile/anatase mixed crystal titanium oxide as an external additive of toner particles. This simple method improves fluidity of toners through the uniform and thorough hydrophobic processing and prevents mutual union of particles. In addition, toners having stabilized friction charge are obtained without being affected by environmental conditions by retaining a moderate intrinsic volume resistance. Further, even when silica is added jointly as an external additive to a toner using the rutile/anatase mixed crystal titanium oxide, titanium oxide is satisfactorily dispersed on the toner particles and extremely excellent fluidity is obtained. At the same time, an extremely excellent durability against friction with such frictional charge given member as carrier, etc. is obtained and therefore, extremely satisfactory toners in respect of stable durability of friction charge and maintenance of fluidity is obtained.

Next, the preferred embodiments of the present invention will be described. First, a manufacturing example of rutile/anatase mixed crystal titanium oxide is shown below. After vaporizing or atomizing such material of volatile titanium compound as titanic alkoxide, this vaporized or atomized material is decomposed at 300–800° C. to titanium oxide fine particles and cooled to a temperature at where they are not united again (preferably below 100° C.). At this time, it is desirable to immediately cool the titanium oxide in as short a time as possible.

As materials for the volatile titanium compound, it is possible to use such titanium compounds having volatility as titanic alkoxide including titanic tetrametoxide, titanic tetraethoxide, titanic tetraprotoxide, titanic tetrabutoxide and diethoxytitaniumoxido, such titanium halide as 4-titanium chloride and 4-titanium bromide, monoalkoxy titanium tribalogenation, sialcoxititanium dihalide, trialcoxiti6tanum monohalide. As volatile titanium compounds are decomposed after vaporized or atomized, gas containing oxygen & hydrogen is needed.

Rutile/anatase mixed crystal titanium oxide obtained as described above was identified according to the X-ray diffraction and a ratio of rutile titanium oxide and anatase titanium oxide was obtained from diffraction strength.

Further, the hydrophobic degree of silica or titanium oxide can be measured according to the following method. That is, put 50 ml water in a 200 ml beaker and further, add 0.2 g silica or titanium oxide. Then, while slowly stirring the mixture in the beaker with a magnet stirrer, add methanol from a burette of which end is immersed in the water when dropping the methanol. When the floating silica or titanium oxide begins to sink and reading the number of milliliters of the dropped methanol when completely sank, obtain the hydrophobic degree from Numerical Formula 1.

Hydrophobic Degree=(Number of ml of dropped methanol/50+Number of ml of dropped methanol)×100. . . (Numerical Formula 1)

In this case, methanol acts as a surface active agent and floating silica or titanium oxide is dispersed in the water via methanol with the drop of methanol and therefore, it may be said that the larger a value of hydrophobic degree is, the higher the hydrophobic degree of titanium oxide is. As a processing agent that is favorably usable in this embodiment, coupling agents are pointed out; that is, for instance, a silane coupling agent, titanium coupling agent, etc. and a silane coupling agent is particularly used favorably and is generally as shown in Chemical Formula 1; wherein R: alkoxy, m: an integer of 1–3, Y: hydrocarbon radical including alkyl, vinyl, metacrylic and n: an integer of 1–3.

Rm-Si-YnR . . . (Chemical Formula 1)

Materials shown below can be pointed out as actual processing agents: vyniltrimethoxysilane, vyniltriethoxysilane, γ-methacrylicoxypropyltraimethocysilane, vynilltriacetoxysilane, methyltrimethoxysilane, methyltriethoxysilane, isobutyltrimethoxysilane, dimethyldimethoxysilane, dimethyldiethoxysilane, trimethylmethoxysilane, hydroxypropiltrimethoxysilane, phenyltrimethoxysilane, n-hexadecyltrimethoxysilane, n-octadecyltrimethoxysilane, etc.

The process quantity is 3–40 weight % against titanium oxide 100 weight %, and the hydrophobic degree is 80–98%. If the hydrophobic degree is below 80%, drop in charge amount resulting when left for a long period under high humidity will become large and the process exceeding the hydrophobic degree 98% is actually difficult. To increase the hydrophobic degree to 98% or above, it is possible to use much processing agent or use processing agents of high viscosity. However, a long time is needed for the hydrophobic process, united particles are produced at the state of hydrophobic process and the charge control of obtained titanium oxide itself becomes difficult and results in increase in the charge amount of toner under low humidity.

For the hydrophobic processing, for instance, a method to immerse fine particles of titanium oxide in a solution containing coupling agent and then dry them or a method to spray a solution containing coupling agent to fine particles of titanium oxide can be selected. Further, as another method of the hydrophobic process, there is a hydrophobic processing method to process fine particles of titanium oxide after decomposed by heating jointly with such refrigerant of inert gas as nitrogen gas when rapidly cooling heated and decomposed titanium oxide fine particles.

Particle size was observed through a transmission type electron microscope and by measuring particle sizes of 1,000 particles in a visual field, a mean particle size was obtained.

A relationship between an external additive strongly adhered to the toner particle surfaces (i.e., an external additive that is not separated from the toner particles by the stirring or mixing when used in a developing device) and an external additive that is not strongly adhered to the toner particle surfaces and is separated or easily separable (i.e., an external additive that is adhered to the surfaces of toner particles immediately after manufactured but is separated from the toner particles by stirring or mixing when used in a devleoping device) is such that a ratio of adherence strength of the external additive is desired to be 90–98%. If the ratio of adherence strength is below 90%, charge characteristic of toner becomes unstable and a density ratio of toner/carrier when tested for a long life may increase or decrease. Further, if a ratio of adherence strength is above 98%, fluidity of toner drops and such problems as toner clamp, etc. are easily generated.

Assuming that the total amount of titanium oxide that is mixed in toner particles is x1 weight portion, the amount of the titanium oxide strongly adhered to the toner particle surfaces is y1 weight portion and the amount of titanium oxide that is separated or easily separable from the toner particles is z1 weight portion, the ratio of adherence strength of external additive (y1/x1) is desirable to satisfy the following formula:

$$90\% \leqq (y1/x1) \leqq 98\%$$

Further, assuming that the total amount of silica that is mixed in toner particles is x2 weight portion, the amount of the silica strongly adhered to the toner particle surfaces is y2 weight portion and the amount of silica easily separated from the toner particles is z2 weight portion, the ratio of adherence strength of external additive (y2/x2) is desirable to satisfy the following formula:

$$90\% \leqq (y2/x2) \leqq 98\%$$

Further, an adding ratio of an external additive to toner particles is desirable to be 0.1–3.0 weight portion to 100 weight portion of toner particle.

Further, from experiments a ratio of rutile/anatase mixed crystal titanium oxide to silica to be added to toner particles is desirable to be $x1 \leqq x2$ and $y1/x1 \geqq y2/x2$. The reason for $x1 \leqq x2$ here is as shown below. That is, if titanium oxide is externally added to toner, charge leakage generally tends to occur from toner for the conductive effect of titanium oxide. The rutile/anatase mixed crystal titanium oxide of the present invention has a higher hydrophobic degree than conventional titanium oxide by the hydrophobic process. As a result, the hydrophobic degree of the rutile/anatase mixed crystal titanium oxide of the present invention is higher than that of conventional single crystal titanium oxide including charge leakage and although the amount of charge leakage decreased, its fluidity drops as charge leakage is generated and it is therefore necessary to add much more silica than titanium oxide in order to maintain fluidity.

Further, the reason for $y1/x1 \geqq y2/x2$ is as shown below. First, the main purpose of titanium oxide is to stabilize the charge and refresh the surface of a photo-conductive drum, while the main purpose of silica is to maintain fluidity of toner and therefore, the adherence strength of titanium oxide is stronger than silica. The titanium oxide is strongly adhered to toner so as to maintain durable stability of the charge and has functions to polish the surface of a photo-conductive drum when press fitted to the photo-conductive drum jointly with toner by a cleaning blade and a developing roller so as to always keep the furface of the photo-conductive drum in a fresh state.

On the other hand, silica has a function to maintain a good fluidity by acting as a spacer among toner particles by weakly adhering to toners. Accordingly, in order to maintain characteristics of both titanium oxide and silica, it is required to strongly attach much more amount of titanium oxide to toner than silica. However, the adding amount of silica is much more than titanium oxide and it is originally difficult to increase the adhesion strength higher than titanium oxide and actually impossible and normally the above-mentioned conditions are satisfied.

As a method to obtain the amount of external additive strongly adhered to the surface of toner particles (i.e., an external additive that is not separated from toner mother paricles even when toner is stirred/mixed when used in a developing device) and the amount of external additive that is not adhered strongly to the surface of toner particles or is easily separable (i.e., an external additive that is adhered to the surface of toner particles immediately after manufactured but is separated from toner particles when stirred/mixed when used in a devleoping device), the amount of external additive can be easily obtained using a wind power classifier, etc.

For instance, toner mixed with an external additive is passed through a cyclone with the quantity of airflow of a wind power classifier set at 400–600 mmHg. An external additive that is not strongly adhered to the surface of toner particles or is separated or easily separable therefrom is removed and an external additive strongly adhered to the surface of toner particles is recovered jointly with toner particles from the lower part of the cyclone. The quantity of external additive of the toner before being applied to the wind power classifier and that of toner recovered from the lower part of the cyclone is determined and a ratio obtained of them.

For determining the quantity of external additive, an applicable known analyzing determination method can be applied as required according to the kind of external additive. For instance, such methods as an emission spectrochemical method, an atomic absorption method, an absorption photometry and the like to determine an objective element (after wet decomposing toner and dry determination methods using X-rays or fluorescence, etc.) can be pointed out.

Fluidity of toner was measured by weighing 20 g of toner on a 100 mesh sieve and the weight of toner left on the sieve after putting through the sieve for 30 seconds with a powder tester manufactured by Hosokawa Micron Inc. and according to the measured weight of toner, adequacy of fluidity was judged.

Next, samples of rutile/anatase mixed crystal titanium oxide are shown below. However, raw materials and manufacturing conditions are not restricted to these samples.

(Sample A)

Mixed gas comprising 2 capacity % of 4-titanium chloride vaporized at 150° C., 4 capacity % of hydrogen gas and 94 capacity % of air was supplied to a burner, hydrolyzed by burning at the flame temperature 300–800° C., and the reaction product was immediately left for 30 seconds at 100° C. and rapidly cooled. As a result, crystalline titanium dioxide in mean primary particle size 15 nm was obtained. This titanium dioxide was in the 10% rutile and 90% anatase crystalline form.

Then, 200 g of this titanium dioxide powder was taken in a separable flask having a 5 liter internal capacity, mixed with 20 g hexyltrimethoxysilane in a nitrogen gas atmosphere, heated for 30 minutes at 120° C., cooled to a room temperature and the titanium oxide A of hydrophobic degree 90%, that is Sample A shown in Table 1, was obtained.

(Sample B)

0.5 mol/liter aqueous solution of 4-titanium chloride was added with aqueous ammonia at a room temperature until pH became 3.5 and in succession, heated at 80° C. and held for 30 min. at this temperature so that a neutralized precipitate was obtained. Then, this precipitate was filtered and cleaned, and the obtained cake was dispersed again in water to slurry and was added with ammonium water to adjust its pH to 0.7. Then, this slurry was filtered, cleaned and dried at 110° C. The dried matter thus obtained was burnt at 530° C. for one hour and crystalline titanium dioxide in mean particle size 15 nm was obtained. The crystal form of this titanium dioxide was 80% rutile and 20% anatase.

Then, 200 g of this titanium dioxide powder was taken in a separable flask having a 5 liter inner capacity, mixed with 20 g of hexyltrimethoxysilane thoroughly in the nitrogen gas atmosphere, heated at 120° C. for 30 minutes, cooled to a room temperature and titanium oxide B of hydrophobic degree 80%, that is Sample B shown in Table 1, was obtained.

TABLE 1

Outline of Titanium Oxide used in the Embodiment of the Present Invention

| | Sample A Rutile/anatase mixed crystal | Sample B Rutile/anatase mixed crystal |
|---|---|---|
| Manufacturing Method | Dry type | Wet type |
| Rutile/anatase ratio | 10:90 | 80:20 |
| Particle size (nm) | 15 | 15 |
| Hydrophobic processing agent | Hexyltrimethoxy silane | Hexyltrimethoxy silane |
| Hydrophobic degree | 90 | 80 |

Further, as an external additive to toner particles, silica fine particles, metallic oxide fine particles, cleaning assistants and the like are used in addition to rutile/anatase mixed crystal titanium oxide of the present invention. As silica fine particles, there are silicon dioxide, aluminum silicate, sodium silicate, potassium silicate, zinc silicate, magnesium silicate and the like. As metallic oxide fine particles, there are zinc silicate, titanium oxide, aluminum oxide, zirconium oxide, strontium titanate, barium titanate and the like.

As a cleaning assistant, there are resin fine powder such as polymethylmethacrylate, polyvinylidene fluoride, polytetrafuloroehtylene. These external additives may be applied with such surface processes as hydrophobic process. As a means for mixing external additive, known mixers are usable; however, it is desirable to use, for instance, a high speed streaming mixer. As a high speed streaming mixing device, for instance, Henshel mixer, super mixer, microspeed mixer, etc. are pointed out. In addition, a hybridizer, homogenizer, Kryptron system, turbo-mill, etc. may be usable.

An adherence strength ratio of external additive can be brought in a range of 90–98% according to a mixing condition of the mixing device mentioned above. For instance, when the Henshel mixer that is a high speed streaming mixer was used, it can be achieved by defining the peripheral speed of the mixing/stirring blade end at 10–30 m/s, a mixing time at 1–5 minutes, a ratio of a distance between the deflector end and the mixing tank wall surface and a distance between the deflector shaft and the mixing tank wall surface at ⅛–½. Further, a mixing method to heat a mixing tank jacket to an adequate temperature (a temperature range not to exceed a room temperature; a glass transition point of toner is desirable) by circulating hot water through the mixing tank jacket has an effect in that an adhesion strength ratio is improved.

As a binder resin that is used in this invention, styrene and copolymer of its substitution product and acrylic resin that have been so far used as binder resins for toner particles are usable.

As the above-mentioned styrene and copolymer of its substitution product, for instance, polystylene-homopolymer, hydrogen added styrene resin, styrene-isobutylene copolymer, acrylonitrile-butadiene-stryrene ternary copolymer, acrylonitrilllle-styrene-acrylic ester ternary copolymer, styrene-acrylonitrile copolymer, acrylonitrile-acrylic rubber-sstyrene ternary copolymer, acrylonitrile-polystyrene chloride-stylene termanary copolymer, acrylonitrile-EVA-styrene ternary copolymer, stylene-p-chlorostylene copolymer, styrene-propylene copolymer, stylene-butadien rubber, stylene-maleic ester copolymer, stylene-isobutilene copolymer, stylene-maleic anyhydride copolymer and the like are pointed out.

Further, as acrylic resins, polyacrylate, polymethylmethacrylate, polyethylmethacry, poly-n-butylmethacrylate, polyglicidilmethacrylate, polyacrylate fluoride, stylene-methacrylate copolymer, stylene-butylmethacrylate copolymer, stylene-ethyl acrylate copolymer, etc. are pointed out.

In addition, it is also possible to use polyvinyl chloride, polyvinyl acetate, polyethylene, polypropylene, polyester, polyurethane, polyamide, epoxy resin, phenol resin, urea resin, polyvinylnutylarl, polyacryl acid resin, rosin, denatured rosin, terpene resin, aliphatic or alicyclic hidracarbone resin, aromatic petroleum resin, paraffin chloride, paraffin wax, etc. can be used independently or in mix.

For coloring agent that is used in the present invention, carbon black, organic or inorganic pigment and dye are used. Although there is no special restriction, acetylene black, furnace ack, thermal black, channel black, Ketchen black, etc. are used as carbon black.

Further, as pigment/dye, Fast Yellow G, Benzidine Yellow, Indo Fast Orange, Irgazine Red, Carmine FB, Permanent Bordeaux-FRR, Pigment Orange R, Lithol Red 2G, Lake Red C, Rhodamine FB, Rhodamine B Lake, Phthalocyanine Blue, Pigment Blue, Brilliant Green B, Phthalocyanine Green, Quinacridone, etc. are used independently or in mix.

As a means for mixing/dispersing, a wet dispersion method using a high-speed dissolver, a roll mill, a boll mill. etc. and a melting, mixing and kneading method using a roll, a pressing kneading machine, an internal mixer, a screw type extruder, etc, can be used. Further, as a mixing means, a ball mill, V-shape mixer, Forberg, Henshel mixer, etc. are usable. Further, as a means for roughly pulverize mixtures, for instance, a hammer mill, a cutter mill, a jet mill, a ball mill, etc. are usable.

Further, as a means for finely pulverizing roughly pulverized matters, a jet mill, a high-speed rotary grinder, etc. can be used. Further, as a means for classifying finely pulverized matters, an air streaming classifier is usable.

In the present invention, waxes for improving offset resisting characteristic, charge control agent for controlling frictional charge amount may be blended when necessary. As charge control agent, cathodic control agents such as, for instance, metallic chelate of alkyl salicylic acid, polyester chloride, excessive acid radical polyester, polyolefin chloride, metallic salts of fatty acid, fatty acid soap, etc. are exemplified.

Toner particles involved in the present invention are manufactured as shown below using a binder resin and a coloring agent. First, at least 100 weight portion of a binder resin and 1–10 weight portion of a coloring agent are mixed and dispersed using a high speed flowing mixer such as Henshel mixer, etc. and then, using a pressurizing kneading machine, a roll, etc., heated, fused and kneaded. The mixture thus obtained is roughly pulverized using a hammer mill, a jet mill, etc. Then, after finely pulverized with a jet mill, the mixture is classified to a desired particle size according to the wind power classifying method and mixed with an external additive by a high speed flowing mixer, etc. and the toner of this invention is obtained.

The toner particles thus obtained are applicable to all known developing methods. For instance, such two-component developing methods as a cascade method, a magnetic brush method, a micro-toning method, such single component developing methods containing magnetic material as a conductive single component developing method, an insulating single component developing method, a jumping developing method, a powder cloud method, a fur brush method, a non-magnetic single component developing method for keeping statistically on a toner carrier, transferred and developed in a developing portion can be pointed out.

The composition of actual toner particles that is used in the embodiment of the present invention is as follows:

| | |
|---|---|
| Polyester resin | 100 weight portion |
| Phthalocyanine pigment | 5 weight portion |
| Dye containing gold | 1 weight portion |
| Natural wax | 5 weight portion |

The materials in the above prescription are heated, fused and kneaded and after cooled, pulverized in a jet mill, classified by a wind power classifier and toner particles T in mean volume particle size 8 $\mu$m and particle size in 4–14 $\mu$m are obtained.

Next, the toner particle % with an external additive added will be described below.

(Toner A)

100 weight portion of the above-mentioned toner particles T and 2.0 weight portion of the titanium oxide A shown in Sample A were mixed in Henshel mixer (manufactured by Mitsui-Miike Corp.) under the conditions that the blade tip peripheral speed was 30 m/s, the blade rotary time 5 min., a ratio of a distance between the deflector tip and the mixing tank wall surface and a distance between the deflector shaft and the mixing tank wall surface at ⅓, and Toner A was obtained. At this time, an adhesion ratio of the titanium oxide A to the surface of the toner particle T was 92%.

(Toner B)

100 weight portion of the above-mentioned toner particles T and 2.0 weight portion of the titanium oxide B shown in Sample B were mixed in Henshel mixer (manufactured by Mitsui-Miike Corp.) under the conditions that the blade tip peripheral speed was 20 m/s, the blade rotary time 5 min., a ratio of a distance between the deflector tip and the mixing tank wall surface and a distance between the deflector shaft and the mixing tank wall surface at ⅓, the temperature in the mixing tank at 55° C., and Toner B was obtained. At this time, an adhesion ratio of the titanium oxide B to the surface of the toner particle T was 97%. Further, the glass transition point temperature of the toner was 60° C.

(Toner C)

100 weight portion of the above-mentioned toner particles T and 2.5 weight portion of the hydrophobic silica (NAX-50, manufactured by Japan Aerosil) were mixed in Henshel mixer (manufactured by Mitsui-Miike Corp.) under the conditions that the blade tip peripheral speed was 20 m/s, the blade rotary time 3 min., a ratio of a distance between the deflector tip and the mixing tank wall surface and a distance between the deflector shaft and the mixing tank wall surface at ½, and Toner C was obtained. At this time, an adhesion ratio of Silica to the surface of toner particles T was 90%.

(Toner D)

100 weight portion of the above-mentioned toner particles T and 2.0 weight portion of the titanium oxide A were mixed in Henshel mixer (manufactured by Mitsui-Miike Corp.) under the conditions that the blade tip peripheral speed was 20 m/s, the blade rotary time 3 min., a ratio of a distance between the deflector tip and the mixing tank wall surface and a distance between the deflector shaft and the mixing tank wall surface at 1, and Toner D was obtained. At this time, an adhesion ratio of the titanium oxide A to the surface of toner particles T was 80%.

(Toner E)

100 weight portion of the above-mentioned toner particles T and 2.0 weight portion of the 100% rutile crystal titanium oxide C of hydrophobic degree 50% that was manufactured according to the wet method and hydrophobic processed and the titanium oxide A were mixed in Henshel mixer (manufactured by Mitsui-Miike Corp.) under the same conditions as the manufacturing example of Toner A, and the Toner E was obtained. At this time, an adhesion ratio of the titanium oxide C to the surface of toner particles T was 90%.

(Toner F)

100 weight portion of the above-mentioned toner particles T and 2.0 weight portion of the 100% anatase crystal titanium oxide D of hydrophobic degree 60% that was manufactured according to the wet method and hydrophobic processed and the titanium oxide A were mixed in Henshel mixer (manufactured by Mitsui-Miike Corp.) under the same conditions as the manufacturing example of Toner A and the Toner F was obtained. At this time, an adhesion ratio of the titanium oxide D to the surface of toner particles T was 90%.

Next, embodiments or comparison examples of developers comprising the above-mentioned toners and carrier will be explained below.

(Embodiment 1)

After mixing the Toners A and C at 1:1, these mixed toners are mixed with magnetite in particle size about 50 $\mu$m with a coating layer comprising acrylic denatured silicon using a fluid bed coating device formed as a carrier. 100 weight portion of the carrier was added with 8 weight portion of Toner A and Toner B, respectively, and then mixed for 30 min. by a V-blender, and Developer 1 of Embodiment 1 was obtained.

(Embodiment 2)

After mixing the Toners B and C at 1:1, Developer 2 of Embodiment 2 was obtained according to the same mixing method as in the Embodiment 1 using the same carrier.

(Embodiment 3)

100 weight portion of the above-mentioned Toner A and 2.5 weight portion of the hydrophobic silica (NAX-50, manufactured by Japan Aerosil) were mixed in Henshel mixer (manufactured by Mitsui-Miike Corp.) under the conditions that the blade tip peripheral speed was 20 m/s, the blade rotary time 3 min., and a ratio of a distance between the deflector tip and the mixing tank wall surface and a distance between the deflector shaft and the mixing tank wall surface at ½, and Toner was formed. At this time, an adhesion ratio of Titanium Oxide A or Silica to the surface of toner particles T was 97% or 90%, respectively. Hereafter, using the same carrier as in the Embodiment 1, Developer 3 of Embodiment 3 was obtained according to the same mixing method.

(Embodiment 4)

100 weight portion of Toner particles T, 1.0 weight portion of the titanium oxide A shown in Sample A and 2.5 weight portion of the hydrophobic silica (NAX-50, manufactured by Japan Aerosil) were mixed in Henshel mixer (manufactured by Mitsui-Miike Corp.) under the conditions that the blade tip peripheral speed was 40 m/s, the blade rotary time 10 min., and a ratio of a distance between the deflector tip and the mixing tank wall surface and a distance between the deflector shaft and the mixing tank wall surface at ⅓, and a mixed toner was formed. At this time, an adhesion ratio of Titanium Oxide A or Silica to the surface of toner particles T was 97% or 93%, respectively. Hereafter, using the same carrier as in the Embodiment 1, Developer 4 of Embodiment 4 was obtained according to the same mixing method.

COMPARISON EXAMPLE 1

After mixing the Toner D and Toner C at 1:1, Developer 5 of Comparison Example 1 was obtained using the same carrier as in Embodiment 1 and according to the same mixing method.

COMPARISON EXAMPLE 2

100 weight portion of the above-mentioned Toner D and 2.5 weight portion of the hydrophobic silica (NAX-50, manufactured by Japan Aerosil) were mixed in Henshel mixer (manufactured by Mitsui-Miike Corp.) under the conditions that the blade tip peripheral speed was 20 m/s, the blade rotary time 3 min., and a ratio of a distance between the deflector tip and the mixing tank wall surface and a distance between the deflector shaft and the mixing tank wall surface at ½, and a toner was formed. At this time, an adhesion ratio of Titanium Oxide A or Silica to the surface of toner particles T was 85% or 90%, respectively. Hereafter, using the same carrier as in the Embodiment 1, Developer 6 of Comparison Example 2 was obtained according to the same mixing method.

COMPARISON EXAMPLE 3

After mixing the Toner E and Toner C at 1:1, Developer 7 of Comparison Example 3 was obtained using the same carrier as in Embodiment 1 and according to the same mixing method.

COMPARISON EXAMPLE 4

After mixing the Toner F and Toner C at 1:1, Developer 8 of Comparison Example 4 was obtained using magnetite in particle size about 50 $\mu$m having no coating layer of resin as the carrier according to the same mixing method.

The copy tests were conducted on the developers thus manufactured shown in the Embodiments 1–4 and the Comparison Examples 1–4 using a copying machine made by Toshiba (Product Name: Premage 251) which has a two-component developing device. A developing device 10 shown in FIG. 1 is arranged facing the developing position of a photo-conductive drum 11 on which an electrostatic latent image is formed by an image forming means (not shown) according to the rotation in the arrow direction x.

A toner container 12 contains developer 13 comprising toner and carrier and at its photo-conductive drum 11 side, a magnetic roller 14 and a developing sleeve 15 that is mounted on the outer surface of the roller 14 are installed. On the surface of the developing sleeve 15, the carriers of the developers 13 are adhered by the magnetic force of the magnetic roller 14 and toners are adhered to the surfaces of the carriers, forming a toner layer. The magnetic roller 14 is stationary, the developing sleeve 15 is rotated in the arrow direction y and the developer 13 is conveyed at any time according to the rotation of this developing sleeve. Further, the conveying amount of the developer 13 is controlled by a doctor blade 16. Reference Numeral 17 shows a power supply to apply developing bias, and at a point where the photo-conductive drum 11 and the developing sleeve 15 come close to each other, the developer 13 is adhered to an electrostatic latent image on the photo-conductive drum 11 from the developing sleeve 15 by the electrostatic attraction and the development is made. Further, Reference Numerals 18 and 20 show mixing rollers which mix and convey the developer 13 in the toner container 12 and frictionally charge the toners.

Here, the charge amount of toners was measured with a blow-off powder charge amount measuring device Model TB-220 manufactured by Toshiba Chemical Corporation. A T/C density ratio that is a density ratio of toners to carriers was obtained by measuring weight of a fixed amount of the developer after removing toners by flowing off with the air. The image density was measured using Macbeth densitometer. The fluidity was measured using a powder tester. The environmental characteristic was measured under the conditions of low temperature, low humidity (10° C., 20% RH), high temperature, high humidity (30° C., 80% RH) and room temperature and room humidity (20° C., 50% RH). The toner scattering was evaluated by observing the peripheral portions of the developing device in the occupying machine.

For the copy test, 10,000 sheets were copied at a low temperature and a low humidity, 10,000 sheets at a high temperature and a high humidity, and 30,000 sheets at a room temperature and a room humidity.

Thus, for the developers of the Embodiment 1–4 and the Comparison Examples 1–4, the evaluation results shown in Table 2 were obtained. Further, the symbols in the evaluation denote as follows: ○: satisfactory without any problem, Δ: somehow usable, x: not usable.

TABLE 2

Results of Embodiments & Comparison Examples of the Present Invention

| | | Embodiment 1 | Comparison Example 1 | Embodiment 2 | Embodiment 3 | Embodiment 4 | Comparison Example 2 | Comparison Example 3 | Comparison Example 4 |
|---|---|---|---|---|---|---|---|---|---|
| Charged Amount | Toner Initial | −5.05 | −1.17 | −4.56 | −5.05 | −4.98 | −4.25 | −4.33 | −4.12 |
| | Toner 50K | −4.5 | +1.15 | −4.31 | −4.63 | −4.65 | −1.90 | −2.00 | −1.55 |

TABLE 2-continued

Results of Embodiments & Comparison Examples of the Present Invention

| | | Embodiment 1 | Comparison Example 1 | Embodiment 2 | Embodiment 3 | Embodiment 4 | Comparison Example 2 | Comparison Example 3 | Comparison Example 4 |
|---|---|---|---|---|---|---|---|---|---|
| Density Ratio | Developer Initial | 8.0 | 8.0 | 8.0 | 8.0 | 8.0 | 8.0 | 8.0 | 8.0 |
| T/C | Developer 50K | 7.8 | 12.0 | 7.7 | 8.1 | 7.9 | 5.5 | 4.5 | 10.3 |
| Environmental Characteristic | | ○ | × | ○ | ○ | ○ | × | Δ | × |
| Fluidity | | ○ | Δ | ○ | ○ | ○ | Δ | × | Δ |
| Image Density | | ○ | × | ○ | ○ | ○ | Δ | × | × |
| Toner Scattering | | ○ | × | ○ | ○ | ○ | Δ | Δ | × |
| Overall Evaluation | | ○ | × | ○ | ○ | ○ | Δ | × | × |

The Developers 1–4 in the Embodiments 1–4 held good charge amounts from the initial stage of toner until completing the copy in the fixed number of sheets, did not become inferior in fluidity, with a satisfactory T(Toner)/C (Carrier) density ratio, image density, etc., providing a high indicating quality without contaminating the environment by scattering toner, and presenting the excellent characteristic.

The toner in the Embodiment 1 is manufactured by adding titanium oxide and silica to the toner particles T separately and then mixing them. That is, toner particles with titanium oxide added externally and toner particles with silica added externally exist in mix. Accordingly, the toner particles with externally added titanium oxide function mainly for improving friction charge durable stability and the toner particles with silica added externally function mainly for improving fluidity; and, as a result of uniform mixing of these toners and external additives, the effect of the friction charge durable stability and maintenance of fluidity are obtained.

In the toners in the Embodiment 2, there exist the toner particles with titanium oxide added externally and the toner with silica added external in mix likewise in the Embodiment 1. Furthermore, adhesion strength of titanium oxide increased higher than the Embodiment 1 by making the external adding condition for titanium oxide more severe. As a result, an effect to improve frictional charge durable stability is obtained.

The toners in the Embodiment 3 are manufactured by externally adding titanium oxide to the toner particles T and then by externally adding silica. That is, the adhesion strength of titanium oxide is further increased after two external additions so that the adhesion strength of titanium oxide can be increased higher than that in the Embodiment 1 and the same effect as in the Embodiment 2 is obtained.

The toner in the Embodiment 4 is manufactured by adding titanium oxide and silica simultaneously to the toner particles T. Accordingly, to obtain a specified adhesion strength, it becomes necessary to set conditions for specifying the adhesion ratio of titanium oxide and silica separately. However, as the external adding process is completed in one step, such an effect is obtained that the process is simplified and the manufacturing efficiency is improved. It is needless to say that frictional charge durable stability and maintenance of fluidity are obtained likewise the Embodiments 1–3.

In the case of Developer 5 in the Comparison Example 1, as the adhesion ratio of the titanium oxide A to the toner particles T was low, its charging characteristic became unstable, the charge amount was low from its initial stage, sufficient image density couldn't be obtained and the surroundings were contaminated by scattering toners, and, after completing the copying of specified number of sheets, it was charged to the reverse polarity. Further, Developer 6 in the Comparison Example 2 was usable because the satisfactory charge amount was obtained at the initial state of toners although the adhesion ratio of the titanium oxide A to the toner particles T was low. However, after completing the copying of specified number of sheets, the contamination of surroundings was caused by scattering toners and the indicating quality was lowered because of drop in the charge amount.

Further, Developer 7 in the Comparison Example 3 was inferior in fluidity because the titanium oxide C in rutile structure only was used. Although its T/C ratio, image density, etc. were satisfactory in the initial state of toners, the T/C density ratio dropped with the increase in the number of copy sheets, sufficient image density couldn't be obtained and the indicating quality dropped. Further, Developer 8 in the Comparison Example 4 used titanium oxide D in the anatase structure only and, therefore, its charge characteristic became unstable, and in particular, at a high temperature and humidity, the charge amount dropped and sufficient image density couldn't be obtained and the indicating quality dropped and the surroundings were contaminated by scattering toners.

In the structure as described above, when rutile/anatase mixed crystal titanium oxide A or B is added externally to toner particles T, the toners in the developer are able to obtain stabilized friction charge irrespective of environmental conditions of temperature and humidity and a clear and satisfactory image that has a sufficient image density can be obtained without causing the contamination by scattering toner and the fog of image. Furthermore, durability of developers can be improved without causing its blocking. Further, when the adhesion ratio of the titanium oxide A or B and silica to the toner particle surfaces is defined to a range of 90–98%, a satisfactory toner charge characteristic can be retained and in turn a good indicating quality can be maintained without impairing fluidity of developers irrespective of increase in the number of copy sheets.

Further, the present invention is not restricted to the above-mentioned embodiments and designs. For instance, a mixing ratio of rutile titanium oxide with anatase titanium oxide is optional, and the hydrophobic degree is also optional for more than 80%. Further, the adhesion ratio of rutile/anatase mixed crystal titanium oxide and silica to the toner particle surfaces is optional within the range of 90–98%. In addition, the structure of carrier comprising a developer, etc. is also not restricted.

As explained above, according to the present invention, when rutile/anatase mixed crystal titanium oxide is added as an external additive of toner, fluidity of toner is improved without impairing color reproducibility and transparency in a full color image and stabilized frictional charge is obtained without being governed by environmental conditions of temperature and humidity. Accordingly, irrespective of environmental variance, a clear full color image in sufficient density is obtained and the quality of image can be improved. Further, the contamination of an image and surroundings by scattering toner are prevented and furthermore, a long life of two component developers is obtained by preventing its blocking resulting from secular change.

What is claimed is:

1. Toner comprising:

toner particles containing binder resin and coloring agents;

rutile/anatase mixed crystal titanium oxide externally added to the toner particles and hydrophobic processed; and hydrophobic silica externally added to the toner particles;

wherein when assuming that the total amount of titanium oxide that is mixed with the toner particles is x1 weight portion, and the amount of titanium oxide that is strongly adhered to the toner particle surfaces is y1 weight portion, $$90\% \leqq (y1/x1) \leqq 98\%;$$

wherein when assuming that the total amount of silica mixed with the toner particles is x2 weight portion, and the amount of the silica strongly adhered to the toner particle surfaces is y2 weight portion, $$90\% \leqq (y2/x2) \leqq 98\%;$$

and wherein the relation between x1 and x2 is $x1 \leqq x2$, and when assuming that the toner particles are 100 weight portion, x1=0.1–3.0 weight portion, x2=0.1–3.0 weight portion, and $y1/x1 \geqq y2/x2$.

2. Developers comprising:

toner particles containing binder resin and coloring agents;

rutile/anatase mixed crystal titanium oxide externally added to the toner particles and hydrophobic processed;

hydrophobic silica externally added to the toner particles; and silicon resin coated carrier;

wherein when assuming that the total amount of titanium oxide that is mixed with the toner particles is x1 weight portion, and the amount of the titanium oxide that is strongly adhered to the toner particle surfaces is y1 weight portion, $$90\% \leqq (y1/x1) \leqq 98\%;$$

wherein when assuming that the total amount of silica mixed with the toner particles is x2 weight portion, and the amount of the silica strongly adhered to the toner particle surfaces is y2 weight portion, $$90\% \leqq (y2/x2) \leqq 98\%$$

and wherein the relation between x1 and x2 is $x1 \leqq x2$, and when assuming that the toner particles are 100 weight portion, x1=0.1–3.0 weight portion, x2=0.1–3.0 weight portion, and $$y1/x1 \geqq y2/x2.$$

3. A method for manufacturing toner comprising the steps of:

preparing toner particles; and externally adding hydrophobic processed rutile/anatase mixed crystal titanium oxide and hydrophobic silica to the toner particles simultaneously;

wherein when assuming that the total amount of titanium oxide that is mixed with the toner particles is x1 weight portion, and the amount of titanium oxide that is strongly adhered to the toner particle surfaces is y1 weight portion, $$90\% \leqq (y1/x1) \leqq 98\%;$$

wherein when assuming that the total amount of silica mixed with the toner particles is x2 weight portion, and the amount of the silica strongly adhered to the toner particle surfaces is y2 weight portion, $$90\% \leqq (y2/x2) \leqq 98\%;$$

and wherein the relation between x1 and x2 is $x1 \leqq x2$, and when assuming that the toner particles are 100 weight portion, x1=0.1–3.0 weight portion, x2=0.1–3.0 weight portion and $$y1/x1 \geqq y2/x2.$$

4. A method for manufacturing toner comprising the steps of:

preparing toner particles;

externally adding hydrophobic processed rutile/anatase mixed crystal titanium oxide to the toner particles to form titanium oxide mixed particles;

externally adding hydrophobic silica to the toner particles to form silica mixed particles; and mixing the titanium oxide mixed particles with the silica mixed particles;

wherein when assuming that the total amount of titanium oxide that is mixed with the toner particles is x1 weight portion, and the amount of titanium oxide that is strongly adhered to the toner particle surfaces is y1 weight portion, $$90\% \leqq (y1/x1) \leqq 98\%;$$

wherein when assuming that the total amount of silica mixed with the toner particles is x2 weight portion, and the amount of the silica strongly adhered to the toner particle surfaces is y2 weight portion, $$90\% \leqq (y2/x2) \leqq 98\%;$$

and wherein the relation between x1 and x2 is $x1 \leqq x2$, and when assuming that the toner particles are 100 weight portion, x1=0.1–3.0 weight portion, x2=0.1–3.0 weight portion, and $$y1/x1 \geqq y2/x2.$$

5. A method for manufacturing toner comprising the steps of:

preparing toner particles;

externally adding hydrophobic processed rutile/anatase mixed crystal titanium oxide to the toner particles to form titanium oxide mixed particles; and externally adding hydrophobic silica to the titanium oxide mixed particles;

wherein when assuming that the total amount of titanium oxide that is mixed with the toner particles is x1 weight portion, and the amount of titanium oxide that is strongly adhered to the toner particle surfaces is y1 weight portion, $$90\% \leqq (y1/x1) \leqq 98\%;$$

wherein when assuming that the total amount of silica mixed with the toner particles is x2 weight portion, and the amount of the silica strongly adhered to the toner particle surfaces is y2 weight portion, $$90\% \leqq (y2/x2) \leqq 98\%;$$

and wherein the relation between x1 and x2 is $x1 \leqq x2$, and when assuming that the toner particles are 100 weight portion, x1=0.1–3.0 weight portion, x2=0.1–3.0 weight portion, and $$y1/x1 \geqq y2/x2.$$

6. A method for manufacturing developer comprising the steps of:

preparing toner particles;

externally adding hydrophobic processed rutile/anatase mixed crystal titanium oxide and hydrophobic silica simultaneously to the toner particles to form toner; and mixing the toner and silicon resin coated carrier;

wherein when assuming that the total amount of titanium oxide that is mixed with the toner particles is x1 weight portion, and the amount of titanium oxide that is strongly adhered to the toner particle surfaces is y1 weight portion, $$90\% \leqq (y1/x1) \leqq 98\%;$$

wherein when assuming that the total amount of silica mixed with the toner particles is x2 weight portion, and the amount of the silica strongly adhered to the toner particle surfaces is y2 weight portion, $$90\% \leqq (y2/x2) \leqq 98\%;$$

and wherein the relation between x1 and x2 is $x1 \leqq x2$, and when assuming that the toner particles are 100 weight portion, x1=0.1–3.0 weight portion, x2=0.1–3.0 weight portion, and $$y1/x1 \geqq y2/x2.$$

7. A method for manufacturing developer comprising the steps of:

preparing toner particles;

externally adding hydrophobic processed rutile/anatase mixed crystal titanium oxide to the toner particles to form titanium oxide mixed particles;

externally adding hydrophobic silica to the toner particles to form silica mixed particles;

mixing the titanium oxide mixed particles and the silica mixed particles to form toner; and mixing the toner and silicon resin coated carrier;

wherein when assuming that the total amount of titanium oxide that is mixed with the toner particles is x1 weight portion, and the amount of titanium oxide that is strongly adhered to the toner particle surfaces is y1 weight portion, $$90\% \leqq (y1/x1) \leqq 98\%;$$

wherein when assuming that the total amount of silica mixed with the toner particles is x2 weight portion, and the amount of the silica strongly adhered to the toner particle surfaces is y2 weight portion, $$90\% \leqq (y2/x2) \leqq 98\%;$$

and wherein the relation between x1 and x2 is $x1 \leqq x2$, and when assuming that the toner particles are 100 weight portion, x1=0.1–3.0 weight portion, x2=0.1–3.0 weight portion, and $$y1/x1 \geqq y2/x2.$$

8. A method for manufacturing developer comprising the steps of:

preparing toner particles;

externally adding hydrophobic processed rutile/anatase mixed crystal titanium oxide to the toner particles to form titanium oxide mixed particles;

externally adding hydrophobic silica to the titanium oxide mixed particles to form toner; and mixing the toner and silicon resin coated carrier;

wherein when assuming that the total amount of titanium oxide that is mixed with the toner particles is x1 weight portion, and the amount of titanium oxide that is strongly adhered to the toner particle surfaces is y1 weight portion, $$90\% \leqq (y1/x1) \leqq 98\%;$$

wherein when assuming that the total amount of silica mixed with the toner particles is x2 weight portion, and the amount of the silica strongly adhered to the toner particle surfaces is y2 weight portion, $$90\% \leqq (y2/x2) \leqq 98\%;$$

and wherein the relation between x1 and x2 is $x1 \leqq x2$, and when assuming that the toner particles are 100 weight portion, x1=0.1–3.0 weight portion, x2=0.1–3.0 weight portion, and $$y1/x1 \geqq y2/x2.$$

* * * * *